US006079453A

United States Patent [19]

Richardson, III

[11] Patent Number: 6,079,453

[45] Date of Patent: Jun. 27, 2000

[54] REED WITH REED DENTS HAVING MODIFIED CHIN SECTIONS

[75] Inventor: William H. Richardson, III, Greenville, S.C.

[73] Assignee: Palmetto Loom Reed Company, Inc., Greenville, S.C.

[21] Appl. No.: 09/184,097

[22] Filed: Oct. 30, 1998

[51] Int. Cl.[7] ..... D03D 49/62; D03D 47/28

[52] U.S. Cl. ..... 139/192

[58] Field of Search ..... 139/192

[56] References Cited

U.S. PATENT DOCUMENTS

| | | | |
|---|---|---|---|
| 3,818,952 | 6/1974 | Vemeulen et al. | 139/190 |
| 4,354,534 | 10/1982 | Sulser et al. | 139/435 |
| 4,391,305 | 7/1983 | Takahashi . | |
| 4,529,014 | 7/1985 | Rast et al. . | |
| 4,569,376 | 2/1986 | Volland et al. . | |
| 4,606,152 | 8/1986 | Michihara et al. . | |
| 4,787,422 | 11/1988 | Peter et al. | 139/192 |
| 4,989,646 | 2/1991 | Nitta et al. . | |
| 5,029,617 | 7/1991 | Anderson et al. . | |
| 5,245,858 | 9/1993 | Takegawa . | |
| 5,289,852 | 3/1994 | Migliorini et al. . | |
| 5,415,205 | 5/1995 | Stendhouse . | |
| 5,518,041 | 5/1996 | Sora et al. | 139/192 |
| 5,762,110 | 6/1998 | Enomoto et al. . | |

FOREIGN PATENT DOCUMENTS

| | | |
|---|---|---|
| 30 03 277 | 8/1980 | Germany . |

*Primary Examiner*—Andy Falik
*Attorney, Agent, or Firm*—Hardaway/Mann IP Group

[57] ABSTRACT

An improved reed wherein more than half or all of the dents used within the reed have smaller, modified chin sections from those currently used in the art. Also, a reed wherein more than half or all of the dents used within the reed do not have any chin portion at all.

9 Claims, 3 Drawing Sheets

REED WITH REED DENTS HAVING MODIFIED CHIN SECTIONS

BACKGROUND OF THE INVENTION

1. Field of Invention

The present invention relates to air jet looms, especially dents which are placed in reeds and used in the loom and more specifically to the configurations of the dents within the reed as used in such a system.

2. Description of Prior Art

In an air jet weaving machine or loom, a profile reed creates a tunnel configuration through which a pick travels while traversing from one end of the weaving machine to the other end. The tunnel configuration is formed by the alignment of the dents alongside one another in the reed. Usually, each dent has a nose portion and a chin portion wherein the tunnel configuration is formed in the space between the nose portion and the chin portion. When numerous dents are aligned next to one another in a reed, with the nose portions and the chin portions of each individual dent in alignment with those on either side of it, a tunnel is formed. The air jet looms or weaving machines of the present use a main nozzle in combination with subnozzles to propel picks across the weaving machine through the tunnel configuration of the reed. The specific configuration of the dents within the reed effect the weaving process. A few patents listed below show the current state of the art of reeds for the weaving industry.

The U.S. Patent issued to Enomoto et al. (U.S. Pat. No. 5,762,110) titled "Dents For Reed In High-Speed Weaving Machine And Method Of Manufacturing Same" discloses dents that are primarily long and flat and do not have a nose and a chin or have both a full nose and a full chin.

The U.S. Patent to Nitta et al. (U.S. Pat. No. 4,989,646), issued titled "Profiled Reed Dent With Weft Passage Recess"; the U.S. Patent issued to Takegawa (U.S. Pat. No. 5,245,858) titled "Method of Measuring Air-speed In A Reed Groove"; the U.S. Patent to Michihara et al. (U.S. Pat. No. 4,606,152) titled "Method of Polishing Metal Reed Blades Of Air Jet Loom And Apparatus Therefor"; the U.S. Patent to Rast et al. (U.S. Pat. No. 4,529,014) titled "Loom Reed With Plastic Profiled Dents"; and the U.S. Patent to Takahashi (U.S. Pat. No. 4,391,305) titled "Weft Picking Device Of Air Jet Type Weaving Loom" all disclose dents having full nose portions and full chin portions.

The U.S. patent issued to Volland et al. (U.S. Pat. No. 4,569,376) titled "Reed With Incorporated Confiner For Shuttleless Loom With Pneumatic Weft Insertion" shows dents having no or little nose portion at all and a full chin portion.

The Anderson et al. U.S. Patent (U.S. Pat. No. 5,029,617) entitled "Reed With Removable Dents" and the U.S. Patent issued to Stenhouse (U.S. Pat. No. 5,415,205) titled "Double Dent Reed With Increased Separation Between Front And Back Dent Rows both show straight dents with no nose portion or chin portion at all.

And the U.S. Patent to Migliorini et al. (U.S. Pat. No. 5,289,852) entitled "Reed For Textile Machines" discloses a reed having a new and unique form of dent wherein there are teeth formed in the dent and not any nose portion or chin portion.

While the aforementioned patents represent the current state of the art of reeds and dents, there is still room for and a need for improvement in this area. The presently claimed invention was developed to satisfy such needs and improvements by modifying the configuration of dents within the reed from that which is known in the art.

SUMMARY OF THE INVENTION

An objective of the present invention is to provide a reed dent configuration that allows for more space for the warp yarns to move in during the weaving process.

Another objective of the present invention is to provide a reed dent configuration that will help reduce the nozzle marks in certain fabrics that are sensitive to abrasion.

Yet another objective of the present invention is to provide a reed dent configuration that will allow for the position of subnozzles to be closer to the reed than in standard looms.

Still another objective of the present invention is to reduce compressed air consumption on the weaving machine.

And yet another objective of this improved reed dent configuration is to provide increased air pressure within the tunnel of the reed.

Another objective of the present invention is to increase the machine speed without increasing the air consumption by the weaving machine.

To satisfy the stated objectives, improvements have been made to conventional reeds by increasing the number of dents within the reed having a reduced chin portion or no chin portion at all.

The aforementioned objectives will be accomplished as well as other features and advantages of the present invention will become more apparent from the following detailed description. The description of the present invention discloses, in conjunction with the drawings which illustrate by way of example, the principles and of the invention.

DETAILED DESCRIPTION OF THE INVENTION

The art of reeds and dents is well defined and as such, only the portions of the reed and dents in the present invention that distinguish them it from the existing prior art will be described below.

Figure 1:
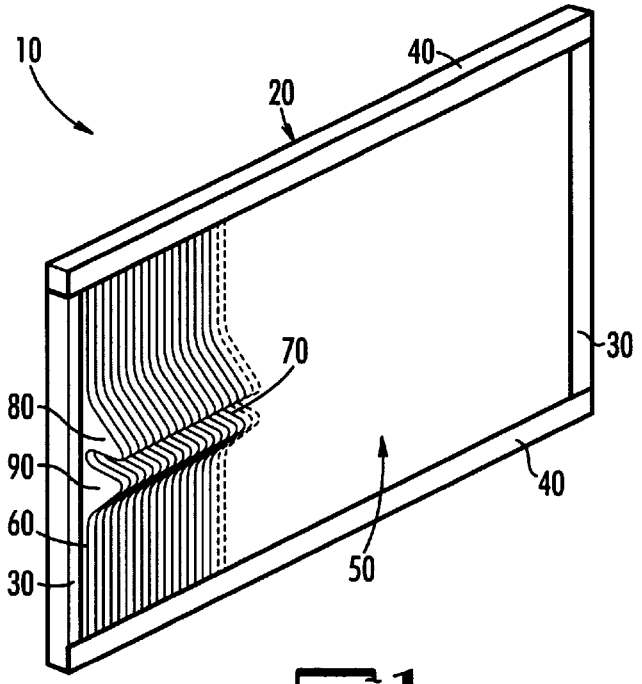
FIG. 1 is a perspective of the improved reed dent configuration.

FIG. 1 is a perspective view disclosing a reed 10 having a frame 20 comprised of two horizontal members 40 which are connected at each end with two vertical members 30. The frame 20 provides the support and stability for a plurality of flat, spaced apart dents 60 which are maintained within the frame 20. The plurality or series of dents 60 are configured in a side by side configuration such that the entire width of the frame 20 is filled with the dents 60. The dents 60 are maintained or held within the frame 20 of the reed 10 by any conventional connecting means such as adhesive. Within each reed dent 10 is formed a tunnel 70. The tunnel 70 is formed in the gap or space between a nose portion 80 and a chin portion 90 of each dent 60. This tunnel 70 space will be better defined below. The tunnel 70 provides a passage for within which a weft yarn travels across the loom between the warp yarns during the weaving process. A main nozzle is positioned at one end of the tunnel 70 and by forcing air through the tunnel 70, it projects the weft yarn through the tunnel 70 to the opposite side of the reed 10. Spaced intermittently along the tunnel 70 are relay or subnozzles which are each positioned at an angle to the tunnel 70 and also force air through the tunnel 70, aiding the weft yard along its path through the tunnel 70 as it passes into the stream of air from each subnozzle. The improved reed herein is better understood with a discussion about the various types of dents 60 used in the claimed invention.

Figure 2:
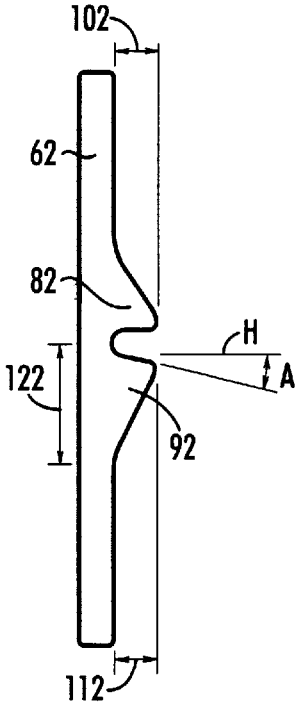
FIG. 2 is a side elevation of a dent having a full chin.

FIG. 2 is a side elevation view of a conventional dent 62 having a full nose portion 82 and a full chin portion 92. The dent 62 in FIG. 2 is referred to as the full chin dent 62. The angle A at which the full chin 92 is positioned is on or near 12 degrees and the width 112 of the chin portion 92 is substantially the same, that is almost the exact width, perhaps slightly less than, but not less than 80% of the width 102 of the nose portion 82. The width 112 of the chin portion 92 and the angle A are of critical importance in the presently claimed invention and they have been modified by reducing the width 112 of the chin and enlarging the angle A at which the chin portion 92 is positioned.

Figure 3:
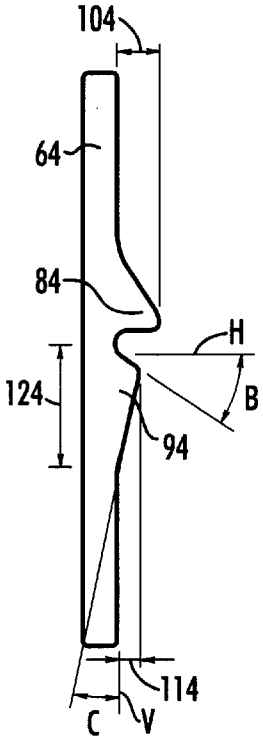
FIG. 3 is a side elevation of a dent having a baby chin.

FIG. 3 is a side perspective view of a modified dent 64 wherein the chin portion 94 is reduced in size compared to the nose portion 84 and the width 114 of the chin portion 94 is less than ½ the width 104 of the nose portion 84 and even closer to being ⅓ the width 104 of the nose portion 84 of the dent 64. The dent 64 in FIG. 3 is commonly referred to as a baby chin dent 64 because of the size of the chin portion 94 is substantially reduced compared to the chin portion 92 in the full chin dent 92. The chin portion 94 of the presently claimed invention can have a variety of heights, for example 30 mm or 32 mm or any other similar height, depending upon preference. It the height is reduced from that of the standard, or for example that of the full chin dent 62, then angle C is increased in relation to the vertical V. In conventional full chin dents 82, the height 122 of the chin portion 92 is commonly 32 mm, wherein the presently claimed baby chin dent 84 the height 124 has been reduced to 30 mm thus reducing angle C. This change in height 122 provides for a stronger chin portion 92.

Figure 4:
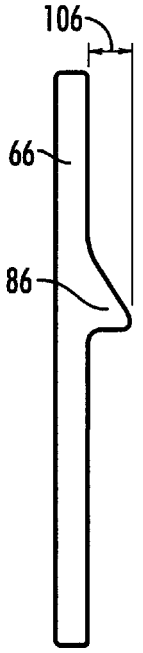
FIG. 4 is a side elevation of a dent without a chin.

FIG. 4 is a side elevation view of a dent 66 having only a nose portion 86 and no chin portion. This type of dent is referred to as a no chin dent 86. The width 106 of the nose is primarily the same as in other types of dents 60 but can be altered if desired.

Figure 5:
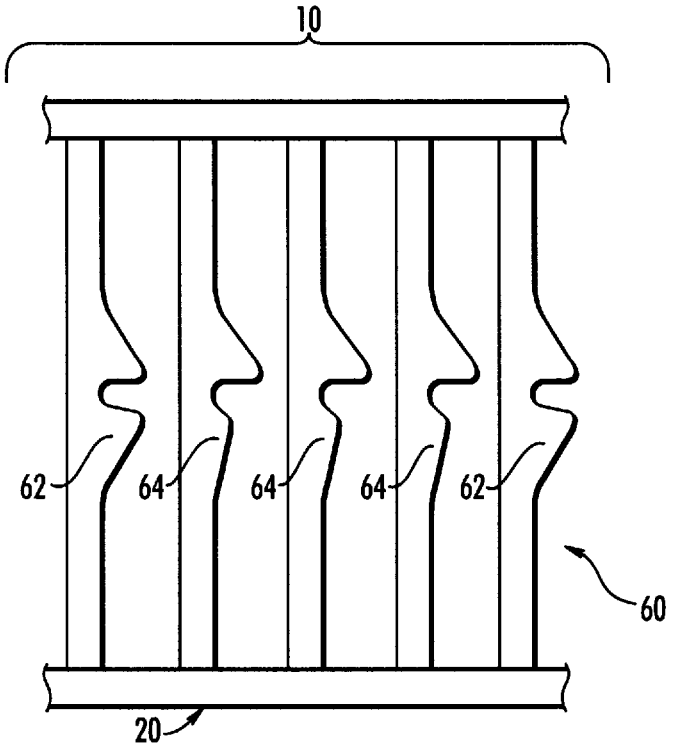
FIG. 5 is an exploded partial perspective view of the improved reed dent configuration.

FIG. 5 is a broken away perspective view of the presently claimed invention showing the relationship of the dents 60 within the reed frame 20. FIG. 5 is used to illustrate that a majority, that is greater than 50%, of the dents 60 are baby chin dents 64 with the remainder of the dents 60 in the reed being full chin dents 62. The change in the configuration of the plurality of dents 60 as having a larger majority of baby chin dents 64 than of full chin dents 62 as shown in FIG. 5 is significant. It is significant because the current state of the art has reeds 10 wherein all the dents 60 are of the same type, i.e. full chin dents, or they are modified so that every other dent is a full chin dent 62 with those dents in between being baby chin dents 64. That means that 50% of the dents 60 in any given reed 10 are full chin dents 62 and 50% are baby chin dents 64 or all 100% of the dents 60 are full chin dents 62. The configuration of all or half of all the dents 60 as being full chin dents 62 limits how closely the subnozzles can be positioned to the tunnel 70 and it also creates a specific tunnel 70 space as defined by the nose portion 82 and the chin portion 92 at angle A. The shape of the tunnel 70 is important in controlling the path in which the weft yarn travels. For example, in a tunnel 70 defined by all full chin dents 62, the weft yarn is capable of wavering from side to side within the tunnel 70 itself. By changing the angle B at which the chin is positioned in a baby chin dent 64, the shape of the tunnel is expanded allowing for the subnozzles to be placed closer to the baby chin dent 64. By placing the subnozzles closer to the baby chin dent 64, they can and are rotated to a smaller angle thus extending the distance which their flow of air travels from 50 mm to 70 mm, which is a significant difference. By extending the distance of air flow from the subnozzles, the overall air consumption of the weaving loom is reduced making the process more economical and faster. Also by extending the flow of air from the subnozzles, the actual path the weft yarn travels is less turbulent, smoother and ultimately less damaging. For example, in the present state of the art, as the weft yarn passes a subnozzle, it is forced to the far side of the tunnel 70 due to the force of the air entering the tunnel 70 from the subnozzle. By reducing the angle at which the subnozzle sits in conjunction with the tunnel 70 and extending the distance of the air flow, the air entering the tunnel 70 from each subnozzle does not have as strong or directly forceful impact on the weft yarn, instead the air entering the tunnel 70 has a smoother transition hence making the path the weft yarn travels less turbulent and smoother, reducing damage to the weft yard and increasing the speed at which it travels through the tunnel 70.

A pilot study was performed on reeds having the standard as well as the present invention which some of the results regarding the speed of the machine and efficiency of the loom are listed below in the following chart:

| Reed Type | Machine Speed | Air Flow (g/sec) | Main Pressure | Sub Pressure |
|---|---|---|---|---|
| Standard | 710 | 10.4 | 1.7 | 3.5/2.5 |
| Standard | 815 | 11.4 | 2.3 | 3.5/2.5 |
| Present Invention | 710 | 8.7 | 1.4 | 2.0/2.5 |
| Present Invention | 815 | 9.0 | 1.9 | 2.0/2.5 |
| Present Invention | 855 | 9.4 | 2.2 | 2.0/2.0 |

The results of this study indicate that by modifying the shape of the dents 60, their configuration within the reed 10 and movement of the subnozzles, a significant impact can be made on performance of the weaving machine. The improved reed of the present invention allows for an increase in machine speed without an increase in air consumption by the weaving machine.

Also, an average of the production levels of a trial machine using the presently claimed invention, a control machine and all machines were measured to determine the run time efficiency of the various machines and the results were as follows:

| | |
|---|---|
| Trial machine | 82.6% |
| Control machine | 88.9% |
| All machines | 82.1% |

The run time efficiency of the various weaving machines were compared for the same style over the same period of time, with the result of the machine using the presently claimed invention as being more efficient than an average of all machines.

Therefore it is clear from the above stated trials that by modifying the reed element of a weaving machine as disclosed herein can and does have a significant impact on the performance of the machine, hence satisfying a need for improvement in the field of reeds.

Figure 6:
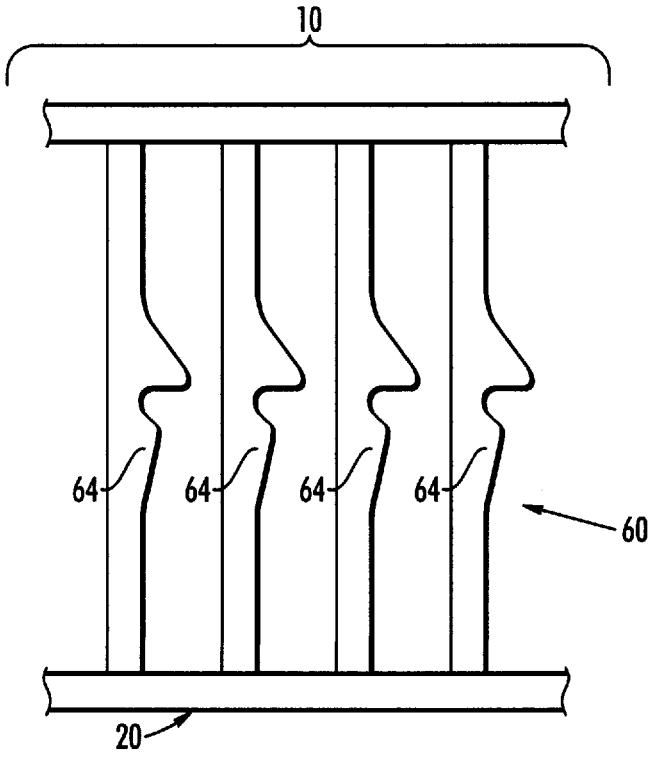
FIGS. 6–8 are exploded partial perspective view of alternative embodiments.
Figure 7:
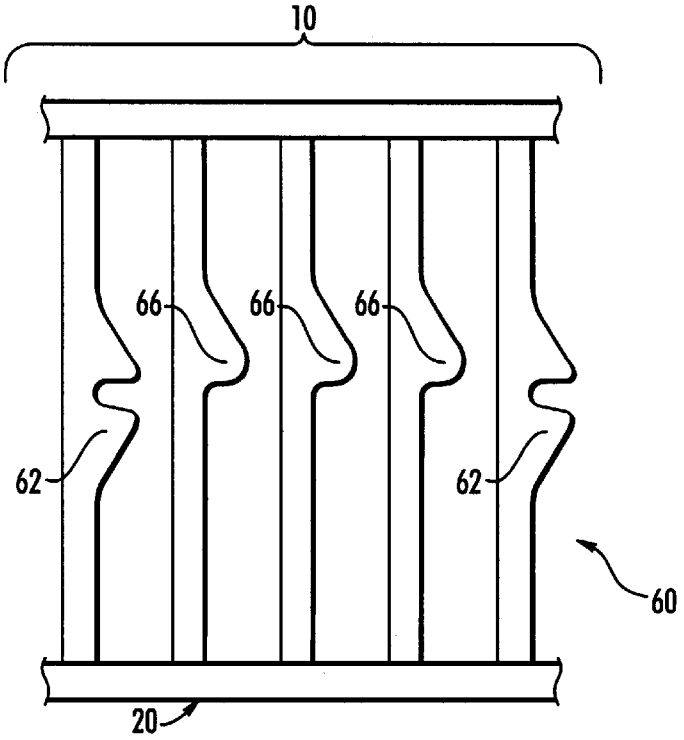
Figure 8:
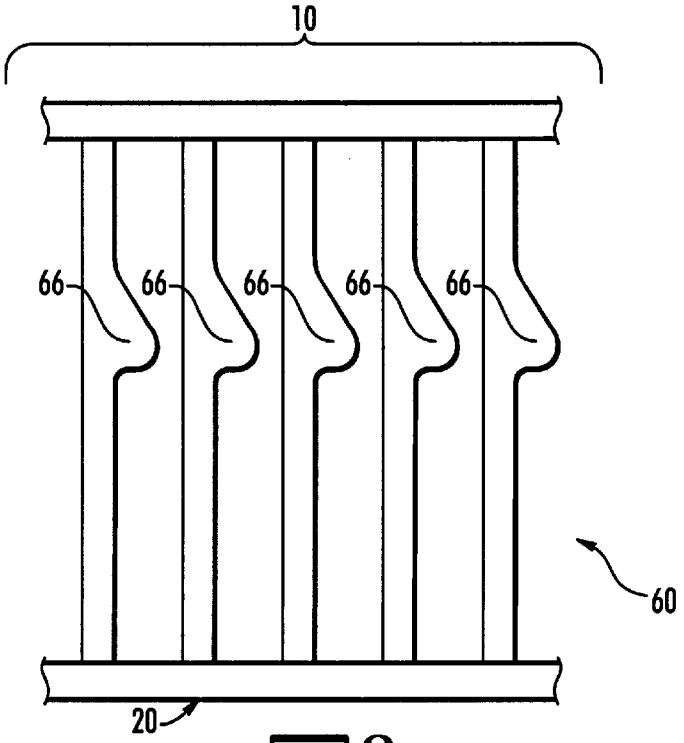

The presently claimed invention also encompasses a few variations of the aforementioned preferred embodiment. In the preferred embodiment, as shown in FIG. 5, the reed 10 is comprised of a majority of baby chin dents 64 with the remainder of dents filling the reed being full chin dents 62. A second embodiment of that invention, shown in FIG. 6, is a reed 10 wherein all the dents 60 are baby chin dents 64. The same objectives and advantages are achieved when all the dents 60 are baby chin dents 64 because again, the subnozzles are capable of being positioned closer to the tunnel 70 thus affecting the flow of air, speed and air consumption by the weaving machine. A third embodiment of the presently claimed invention, as shown in FIG. 7, is where a combination of full chin dents 62 and no chin dents 66 are used in the reed 10, again, the no chin dents comprising greater than 50% of the dents 60 within the reed 10 while the remainder are comprised of full chin dents 64. And a fourth variation or embodiment of the present invention, as shown in FIG. 8, is one in which all the dents 60 within the reed 10 are no chin dents 66, allowing even greater access to the tunnel 70 than in a reed having either full chin dents 62 or baby chin dents 64.

The improved reed 10 described herein and illustrated in the drawings is subject to other advantages and modifications that may be apparent to those of ordinary skill in the art without departing from the spirit and scope of the appended claims. Accordingly, the invention is to be limited only by the scope of the following claims and their equivalents.

What is claims is:

1. An improved reed in an air jet weaving machine comprising:

a frame member for holding dents;

a series of said dents, each dent having a nose portion and a chin portion;

said series of dents being arranged in a side by side configuration;

said configuration comprised of more than half said dents having said chin portion angled at at least a 30 degree angle from the horizontal and also having a width of less than ½ the width of the nose portion;

the remainder of said dents in said configuration having said chin portion angled at at least a 30 degree angle from the horizontal and also having a width substantially equal to the width of said nose portion; and a tunnel;

wherein said configuration of said dents within said improved reed allows for a series of subnozzles to be reconfigured closer to said dents than in conventional weaving machines and the angles at which said subnozzles are placed to be smaller than in conventional weaving machines resulting in a reduction in overall air consumption of the weaving machine.

2. The improved reed of claim 1, wherein:

all of said dents have said chin portion angled at at least a 30 degree angle from the horizontal and also having a width of less than ½ the width of the nose portion.

3. An improved reed in an air jet weaving machine comprising:

a frame member for holding dents;

a series of said dents, each dent having a nose portion and only a portion of said dents having a chin portion, such that said only a portion of said dents have a nose portion only;

said series of dents being arranged in a side by side configuration;

said configuration comprised of more than half said dents having a nose portion only;

the remainder of said dents in said configuration having said chin portion angled at at least a 30 degree angle from the horizontal and also having a width substantially equal to the width of said nose portion;

a tunnel;

wherein said configuration of said dents within said improved reed allows for a series of subnozzles to be reconfigured closer to said dents than in conventional weaving machines and the angles at which said subnozzles are placed to be smaller than in conventional weaving machines resulting in a reduction in overall air consumption of said weaving machine.

4. An improved reed in an air jet weaving machine comprising:

a frame member for holding dents;

a series of said dents, each dent having a nose portion and only a portion of said dents having a chin portion, such that said only a portion of said dents have a nose portion only;

said series of dents being arranged in a side by side configuration;

said configuration comprised of more than half said dents having a nose portion only;

the remainder of said dents in said configuration having said chin portion angled at at least a 30 degree angle from the horizontal and also having a width equal to the width of less than ½ of the width of said nose portion;

a tunnel;

wherein said configuration of said dents within said improved reed allows for a series of subnozzles to be reconfigured closer to said dents than in conventional weaving machines and the angles at which said subnozzles are placed to be smaller than in conventional weaving machines resulting in a reduction in overall air consumption of said weaving machine.

5. An improved reed in an air jet weaving machine comprising:

a frame member for holding dents;

a series of said dents, each dent having a nose portion and none of said dents having a chin portion;

said series of dents being arranged in a side by side configuration; and a tunnel;

wherein said configuration of said dents within said improved reed allows for a series of subnozzles to be reconfigured closer to said dents than in conventional weaving machines and the angles at which said subnozzles are placed to be smaller than in conventional weaving machines resulting in a reduction in overall air consumption of the weaving machine.

6. An improved reed in an air jet weaving machine comprising:

a frame member for holding dents;

a series of said dents, each dent having a nose portion and a chin portion;

said series of dents being arranged in a side by side configuration;

said configuration comprised of more than half said dents having said chin portion angled at at least a 12 degree angle from the horizontal and also having a width of less than ½ the width of the nose portion;

the remainder of said dents in said configuration having said chin portion angled at at least a 12 degree angle from the horizontal and also having a width substantially equal to the width of said nose portion; and a tunnel;

wherein said configuration of said dents within said improved reed allows for a series of subnozzles to be reconfigured closer to said dents than in conventional weaving machines and the angles at which said subnozzles are placed to be smaller than in conventional weaving machines resulting in a reduction in overall air consumption of the weaving machine.

7. The improved reed of claim 6, wherein:

all of said dents have said chin portion angled at at least a 12 degree angle from the horizontal and also having a width of less than ½ the width of the nose portion.

8. An improved reed in an air jet weaving machine comprising:

a frame member for holding dents;

a series of said dents, each dent having a nose portion and only a portion of said dents having a chin portion, such that said only a portion of said dents have a nose portion only;

said series of dents being arranged in a side by side configuration;

said configuration comprised of more than half said dents having a nose portion only;

the remainder of said dents in said configuration having said chin portion angled at at least a 12 degree angle from the horizontal and also having a width substantially equal to the width of said nose portion;

a tunnel;

wherein said configuration of said dents within said improved reed allows for a series of subnozzles to be reconfigured closer to said dents than in conventional weaving machines and the angles at which said subnozzles are placed to be smaller than in conventional weaving machines resulting in a reduction in overall air consumption of said weaving machine.

9. An improved reed in an air jet weaving machine comprising:

a frame member for holding dents;

a series of said dents, each dent having a nose portion and only a portion of said dents having a chin portion, such that said only a portion of said dents have a nose portion only;

said series of dents being arranged in a side by side configuration;

said configuration comprised of more than half said dents having a nose portion only;

the remainder of said dents in said configuration having said chin portion angled at at least a 12 degree angle from the horizontal and also having a width equal to the width of less than ½ of the width of said nose portion;

a tunnel;

wherein said configuration of said dents within said improved reed allows for a series of subnozzles to be reconfigured closer to said dents than in conventional weaving machines and the angles at which said subnozzles are placed to be smaller than in conventional weaving machines resulting in a reduction in overall air consumption of said weaving machine.

* * * * *